United States Patent [19]

Patterson

[11] Patent Number: 4,644,327

[45] Date of Patent: Feb. 17, 1987

[54] METHODS FOR GENERATING AUDITORY INDICATORS

[75] Inventor: Roy D. Patterson, Great Shelford, England

[73] Assignee: National Research Development Corp., London, England

[21] Appl. No.: 515,501

[22] Filed: Jul. 20, 1983

[30] Foreign Application Priority Data

Jul. 30, 1982 [GB] United Kingdom ..... 8222029

[51] Int. Cl.[4] ..... G08B 3/00

[52] U.S. Cl. ..... 340/384 E; 340/521

[58] Field of Search ..... 340/384 E, 384 R, 52 F, 340/945, 517, 521; 328/181, 184

[56] References Cited

U.S. PATENT DOCUMENTS

| | | | |
|---|---|---|---|
| 3,504,364 | 3/1970 | Abel | 340/384 E |
| 4,090,349 | 5/1978 | Takase | 340/384 E X |
| 4,280,123 | 7/1981 | Right et al. | 340/384 R X |
| 4,359,713 | 11/1982 | Tsunoda | 340/521 X |
| 4,417,218 | 11/1983 | Berke | 328/184 X |

FOREIGN PATENT DOCUMENTS

| | | | |
|---|---|---|---|
| 0047231 | 3/1982 | Japan | 340/52 F |

OTHER PUBLICATIONS

*Elektor*, vol. 5, No. 6, Jun. 1979, pp. 6-12 to 6-16, "Programmable Doorbell".

Patterson et al, "The Appropriate Sound Level for Auditory Warnings on Civil Aircraft", prepared at the meeting of the Acoustical Society of America, Atlanta, Georgia, Apr. 1980.

Patterson, "Auditory Filter Shapes Derived with Noise Stimuli", J. Acoust. Soc. Am., vol, 59, No. 3, Mar. 1976, pp. 640-654.

*Primary Examiner*—John W. Caldwell, Sr.

*Assistant Examiner*—Tyrone Queen

*Attorney, Agent, or Firm*—Cushman, Darby & Cushman

[57] ABSTRACT

Existing auditory warning systems are in general too loud and it is often difficult to distinguish between a number of different warnings. Further under different conditions warnings may change character due to masking by varying noise. A warning system is disclosed which is based on a microprocessor and waveforms for each warning sound stored in a ROM. The waveforms are read out to DACs and used to drive a loudspeaker by way of programmable attenuators. Each waveform is devised to have at least four quasi-harmonically related frequency components at a power level in the range 15 to 30 dB above threshold. In this way the sounds are distinctive and do not change character with varying noise levels below threshold.

4 Claims, 9 Drawing Figures

Figure 1:
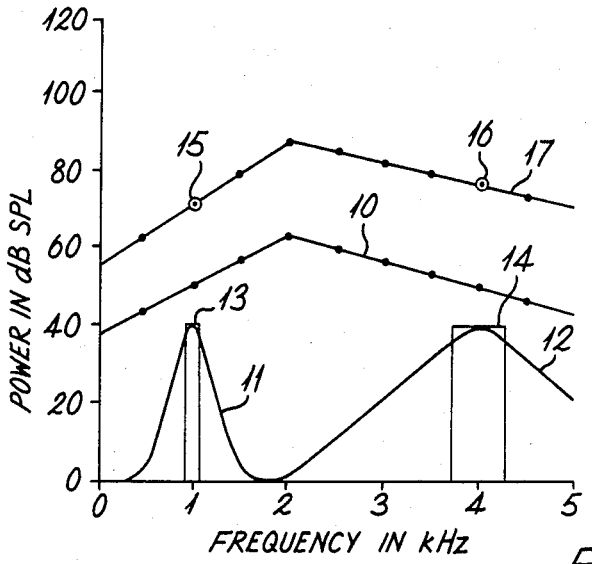

0
0·2
0·4
0·8
1·2
SECONDS
1·6

METHODS FOR GENERATING AUDITORY INDICATORS

The present invention relates to the generation of auditory indicators such as alarms or "attensons"—that is, sounds for gaining attention. Such indicators, called auditory warnings in this specification, are used for example on the flight decks of aircraft, in the operations rooms of ships, in the driving cabs of trains, in electrical generating stations, in factories, in operating theatres, and many other places.

Existing warning systems are in general too loud, disrupting thought and preventing communication between, for example, members of a flight crew. In addition, it is often difficult to distinguish between different warnings (there may be as many as thirteen different auditory warnings in an aircraft), and the sounds generated appear to vary under different background noise conditions, for example at different stages of a flight, and particularly between training on the ground and in flight. Other disadvantages of existing warning systems will be mentioned later.

According to a first aspect of the present invention there is provided apparatus for providing at least four auditory indicators, comprising means for sensing at least three conditions, and means for generating a plurality of sounds, one said sound particular to each condition and associated with that condition, the means for generating sounds being coupled to the sensing means and responsive thereto to generate the associated sound when one of the conditions exists, each said sound having at least four frequency components which are quasi-harmonically related, as hereinafter defined, and each component of each sound having a maximum power level substantially in the range 15 to 30 dB above threshold, as hereinafter defined, and below 110 dB standard pressure level (SPL), and all significant components of the said sounds being in the said range.

According to a second aspect of the invention there is provided a method of generating auditory indicators, comprising sensing if any of at least three conditions exists, and generating a sound associated with, and particular to, any one of the conditions, if that condition exists, each said sound having at least four frequency components which are quasi-harmonically related, as hereinafter defined, and each component of each sound having a maximum power level substantially in the range 15 to 30 dB above threshold, as hereinafter defined, and below 110 dB standard pressure level, and all significant components of the said sounds being in the said range.

The auditory indicators, that is the sounds generated in the two aspects of the invention, are usually alarms or "attensons" (that is, attention-getting sounds). The number of different sounds which can be generated depends on the purpose for which they are required. In many applications at least four such sounds are needed. Hence the conditions are usually equipment malfunctions or some other need to gain someone's attention.

One advantage of the present invention is that the sounds generated are clearly audible over background noise but not too loud to be disruptive. Using four frequency components is an aid in ensuring that distinctive sounds can be provided for many warnings; with these components in the specified level range, sounds do not substantially change character with expected changes in background noise.

The term "threshold" in this specification means that level of a component which would be just audible over the expected maximum background noise. General and simplified expressions for threshold are given later.

For the purposes of this specification components are quasi-harmonically related if the frequency of each component is in a range plus or minus ten percent of a respective integral number of times a common fundamental frequency between 150 and 1000 Hz. Thus each component may have a frequency which is an integral number times the fundamental frequency or one or more components may have frequencies within ten percent of an integral number times the fundamental frequency. Since one of the integral numbers may be one, one of the components may be at the fundamental frequency but, as is explained below, the components of a sound generated by an apparatus or method of the invention need not include the fundamental. It will be apparent from the frequency range specified that each component may be harmonically related to the fundamental. The use of quasi-harmonically related components increases the urgency of a sound.

Preferably each sound is made up of bursts of short pulses so that they have distinctive temporal patterns, the levels of the pulses within each burst varying in a predetermined way and with varying predetermined intervals between pulses. The said maximum power level of components is then the level which occurs in a maximum amplitude pulse.

For reasons explained below, the components of the sounds preferably have frequencies in the range 0.5 kHz to 4 kHz and the residue pitch (i.e. the fundamental frequency) of each sound is between 150 and 1000 Hz.

It is advantageous if each sound has at least six quasi-harmonically related components.

Figure 2:
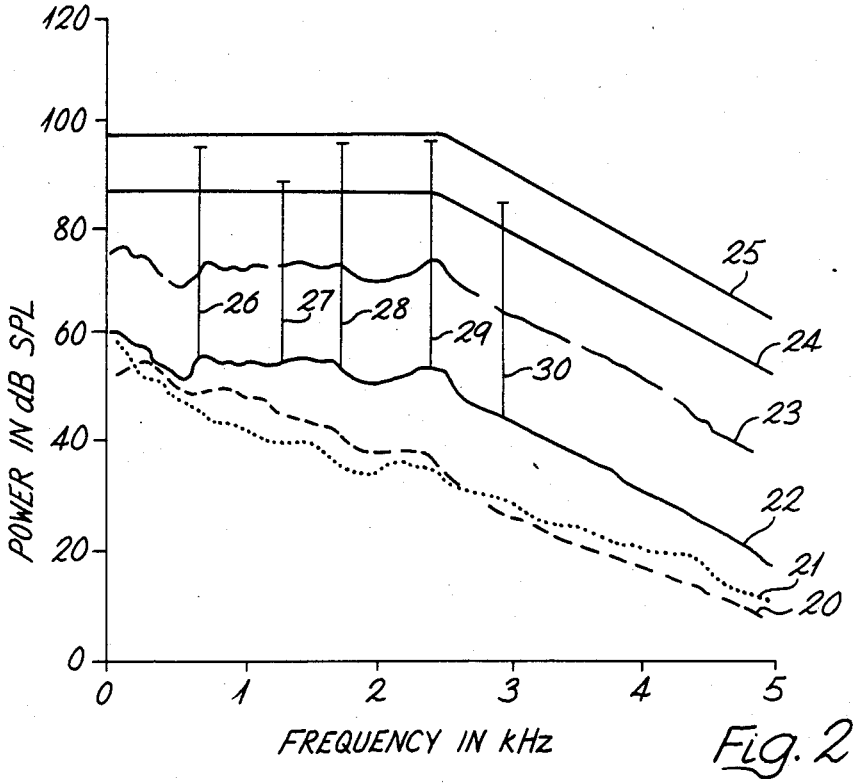
Figures 3A, 3B, 3C, 3D:
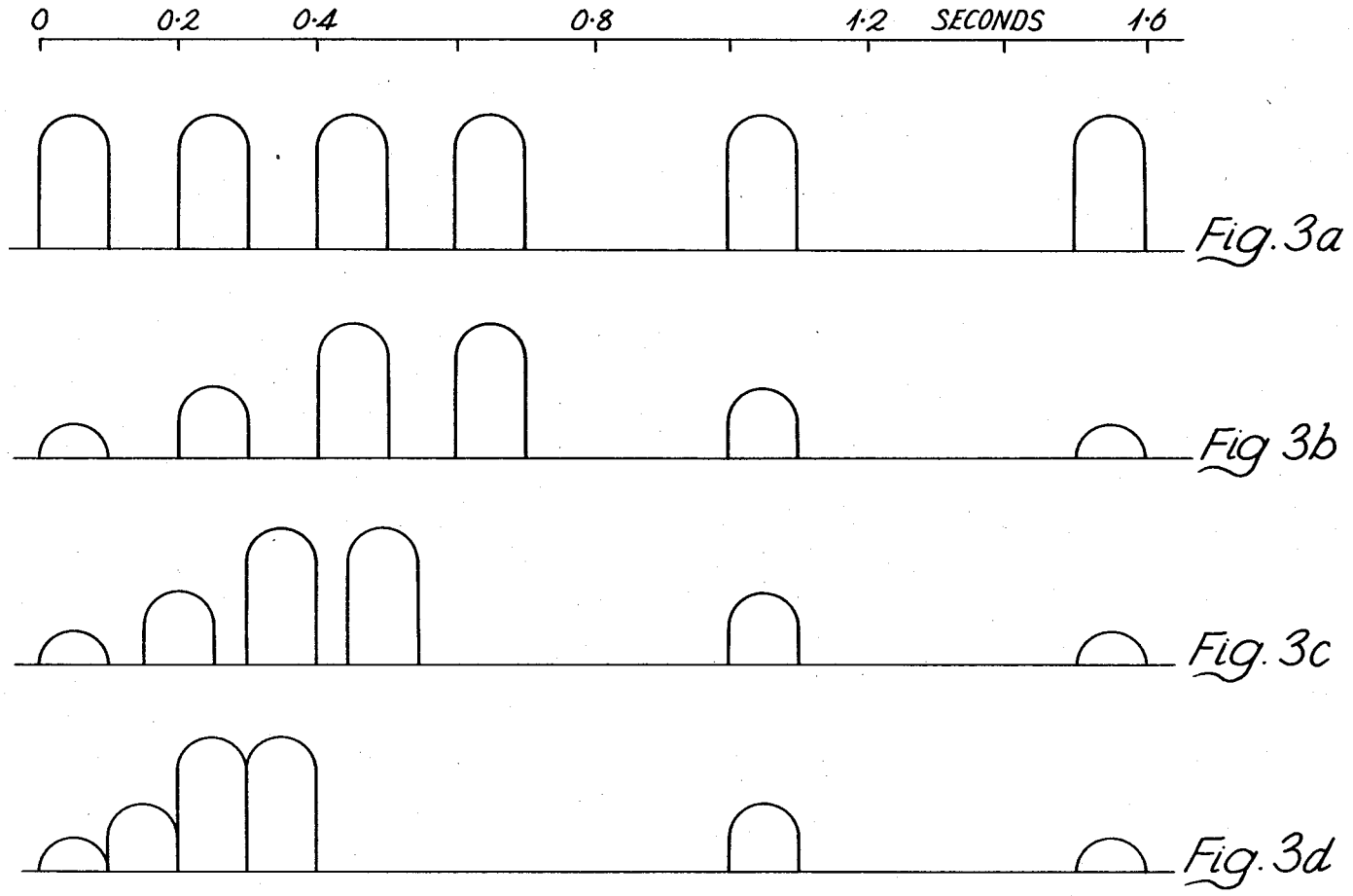
Figure 4:
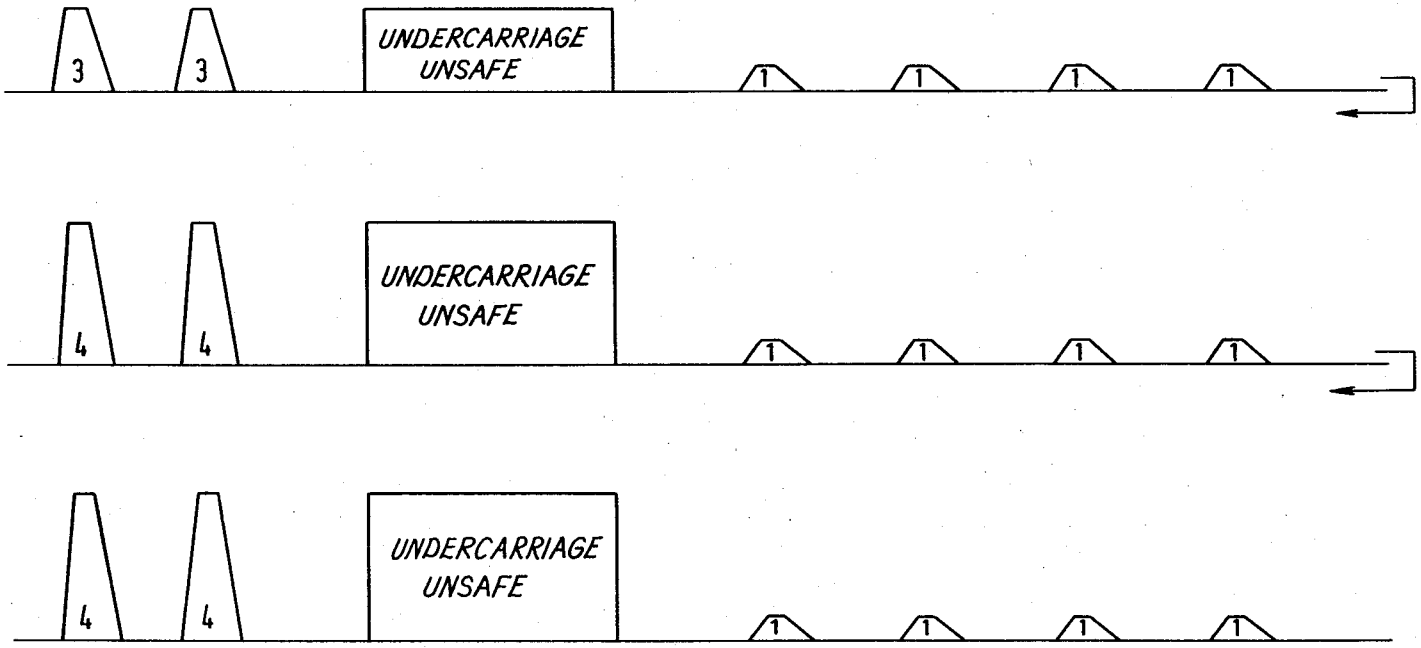
Figure 5:
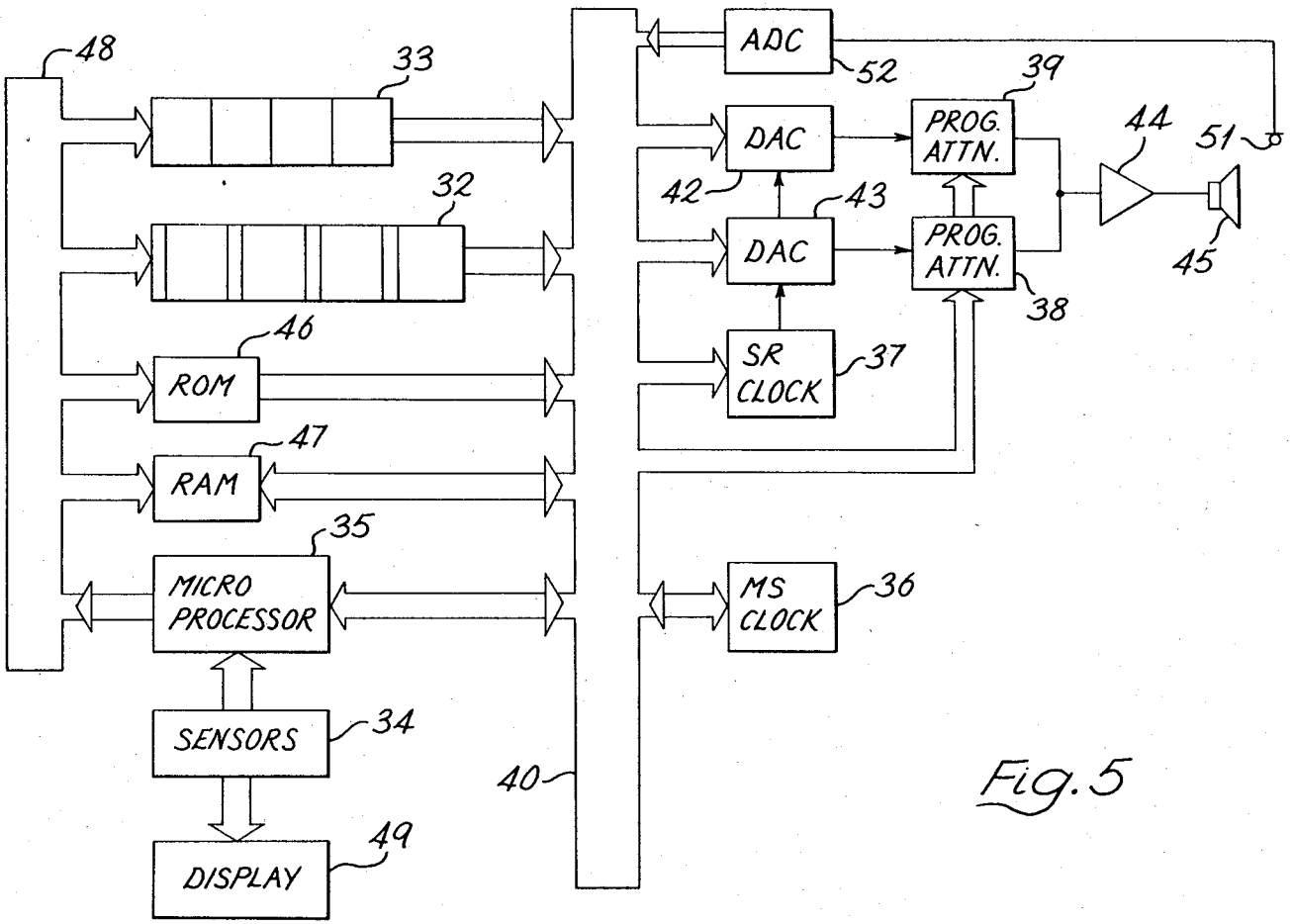
Figure 6:
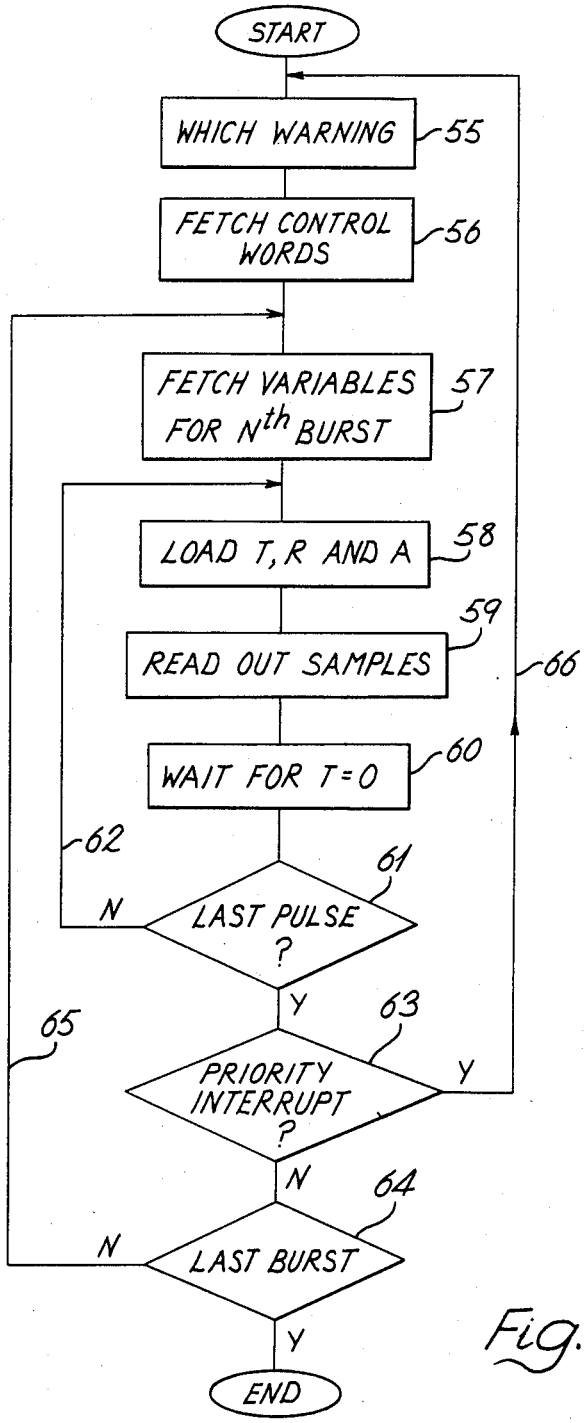

An embodiment of the invention will now be described by way of example with reference to the accompanying drawings in which:

FIG. 1 illustrates the relationship between background noise level and threshold, FIG. 2 illustrates the levels of components of an auditory warning in relation to threshold, FIGS. 3*a* to 3*d* illustrate temporal and amplitude relationships of pulses which may be generated by apparatus according to the invention, FIG. 4 illustrates types of bursts of pulses which form an auditory warning generated by an embodiment of the invention, FIG. 5 is a block diagram of apparatus according to the invention, and FIG. 6 is a flow chart of a program for the microprocessor shown in the block diagram of FIG. 5.

In order to set the appropriate levels of components for an auditory warning, the threshold for the environment concerned must be determined.

The auditory system of the ear and brain processes incoming sound with a fairly detailed frequency analysis, and it is in essence this analysis which determines whether one sound masks another. The auditory system is largely insensitive to the phase of individual frequency components, particularly when the masker is a noise, and auditory warnings are long compared with respect to the integration time of the ear. As a result, a simple power spectrum model can provide quite an accurate representation of a frequency analysis.

Briefly, it is assumed that an observer trying to detect a signal centers an auditory filter at a local peak of the signal spectrum and listens for the signal through that filter. If the power of the signal at threshold is $P_s$ the long-term power spectrum of the noise is N(f), and the auditory filter shape is W(f), then the general equation for the power spectrum model of masking is $$P_s = K \int_{-\infty}^{\infty} N(f)W(f)dF$$

The filter shape can be measured experimentally (see Patterson, R. D, "Auditory Filter Shapes Derived With Noise Stimuli", Journal of Acoustical Society of America, Vol. 59, No. 3 March 1976, pages 640 to 654) and is typical of a resonant, physical system: it has a well defined pass band with an equivalent rectangular bandwidth, $BW_{ER}$, that is roughly 15% of the center frequency. A good approximation to the attenuation characteristic of the filter is provided by a rounded-exponential function of the form $$W(g)=(1-r)(1+pg)e^{-pg}+r$$

where g is the normalised distance in frequency from the center of the filter, $f_c$, ($g=f-f_c/f_c$). The parameter p determines the width of the pass band of the filter and the function is a pair of back to back exponentials ($e^{-pg}$) with the peak rounded off by the term (1+pg) and the dynamic range of the exponential limited by a floor, r. The term (1−r) simply ensures that there is neither loss nor gain at the center frequency.

The filter shape is substituted into the general masking equation to provide an expression for calculating threshold from an arbitrary noise spectrum. The proportionality constant, K, can be assumed to have a value of unity for practical purposes (particularly on flight decks). Thus the general expression for the threshold is $$P_s = f_c \int_{0}^{0.8} N(g)[(1-r)(1+pg)e^{-pg}+r]dg.$$

The constant $f_c$ is required to convert the normalised frequency domain to physical power. Since the limit on the dynamic range is implemented by means of a constant, r, the integration is restricted in frequency to 0.8. This expression can be used to predict threshold whenever the total noise power does not exceed about 95 dBA (decibels with reference to A weighting of USA Standard S1.4-1961 relating to the response of the human ear). Above 95 dBA the auditory filter broadens and the correction must be included.

On the flight deck of modern jet aircraft the noise spectra are fairly smooth. In this special case the noise spectrum can be approximated by a constant $NL_c$: the auditory filter can be approximated by its equivalent bandwidth, $BW_{ER}$; and the masking equation reduces to a simple form:

$$P_s=BW_{ER}.NL_c$$

where $BW_{ER}$ is in Hz and $NL_c$ is in (dynes/cm$^2$)/Hz. Typically both the noise level and the signal power at threshold are expressed in dB SPL; that is in tenths of log-units, where the reference level is 0.0002 dynes/cm$^2$. Thus a more convenient form of the above simple form is $$10 \log P_s=10 \log BW_{ER}+10 \log NL_c$$

where 10 log $P_s$ and 10 log $NL_c$ are in dB SPL. $BW_{ER}$ is approximately 0.15 $f_c$ and it is the width that a rectangular filter with unit height must have to yield the same total area as the auditory filter. Provided the noise spectrum does not fall more than 6 dB across the equivalent rectangular filter, the average noise level in dB SPL can be approximated by the value at $f_c$.

The procedure for calculating threshold as a function of frequency is illustrated in FIG. 1. The spectrum of the flight deck noise is designated 10 and two auditory filters with characteristics 11 and 12 are shown centred at 1 and 4 kHz respectively. Their rectangular equivalents 13 and 14, respectively, are also shown. The appropriate noise level for calculating the threshold at 1 kHz is 50 dB SPL and has the same value at 4 kHz. Thus threshold at 1 and 4 kHz is $$10 \log P_s=10 \log (0.15\times1000)+50=71.8 \text{ dB SPL (for 1 kHz)}$$

$$10 \log P_s=10 \log (0.15\times4000)+50=77.8 \text{ dB SPL (for 4 kHz).}$$

These values are plotted at points 15 and 16 and similar points are plotted to give the complete threshold curve as illustrated by the line 17.

A better threshold value is, of course, obtained by carrying out the convolution of the general expression for threshold given above, where N(g) is the measured noise level for the environment concerned.

A method of specifying suitable sounds for use in the invention, as applied to the flight deck of a civil aircraft, is now described and then a description of apparatus for generating the sounds is given.

Since high levels of sounds below 500 Hz are common in aircraft and hearing efficiency deteriorates below this frequency, a lower frequency limit of 500 Hz for components of warning sounds is preferable. An upper limit of 4 kHz is chosen because about this frequency hearing ability deteriorates with age and may be damaged by long term exposure to noise. In addition the frequency response of existing intercom systems and headsets falls off rapidly above 4 kHz. Thus at least four harmonically related frequencies in the range 500 to 4000 Hz are chosen for each warning, for example the frequencies might be 600, 1200, 1800, 2400, 3000 Hz. If a sound has frequency components separated by equal intervals then the apparent pitch of the sound (the residue pitch) is equal to the interval, that is an apparent fundamental occurs at a frequency equal to the interval. For example components having frequencies of 900, 1050, 1200 and 1350 Hz have an apparent pitch of 150 Hz and are harmonically related. Thus the frequencies chosen for the components may omit the fundamental as long as they are harmonically related.

By choosing at least four components masking by other noises is minimised because it is unlikely that most of the components will be masked. The use of four components in the range 500 to 4000 Hz also allows a sufficient number of distinctive warnings to be provided and restricts the frequency interval between components (that is the residue pitch) to between 150 and 1000 Hz.

Preferably six or more components are chosen for each sound since this reduces the effect of masking one or two components and helps maintain the character of the sound under varying conditions. More scope is also given for making the sounds distinctive.

The threshold curve for the flight deck is now determined in the way described above and a level in the range 15 to 30 dB but preferably 25 dB above threshold is chosen for each component, with at least half the components more than 20 dB above threshold. Preferably, the frequency of one or more components is now changed to make it slightly inharmonic (but still within the term quasi-harmonic as specified above), and to make a sound more urgent the number of inharmonic components is increased.

The position can now be illustrated by FIG. 2 which relates to the BAC 1-11 aircraft as far as flight deck noise is concerned. Lines 20 and 21 show the spectra of flight deck noise during steady climb and steep descent, respectively, and line 22 shows the spectrum of level flight. The threshold is shown by a line 23 as calculated from the level flight spectrum 22 which is greater than spectra 20 and 21 and therefore represents the expected range of background noise. Lines 24 and 25 show lower and upper limits for warning sound components and are positioned approximately 15 and 25 dB, respectively, above threshold. Five sound components 26 to 30 chosen according to the invention are also illustrated.

In existing aircraft alarms there are usually several components more than 30 dB above threshold, with the result that the alarms are much too loud, and several components below 15 dB above threshold, which means that the character of these alarms changes as the lower level components are masked.

The chosen component frequencies and levels are now entered into a computer and an inverse Fourier transform is carried out. In this transform the relative phase of the various components is not important. The transform length may, for example, be 1024 points each with a resolution of 12 bits. The result is 1024 samples representing a single pulse of approximately 100 msec duration of a warning sound when read out at 10,000 samples per second. These samples are stored, in the computer memory. In order to avoid an abrupt start and finish to each pulse, which tends to startle crew members, a "cosine gate" is applied to the first and last 100 samples of the stored pulse; that is to say these samples are multiplied by corresponding samples of an inverted cosine function so offset that the smallest sample is zero (not negative as in a normal inverted cosine function). For the first 100 samples the cosine function increases from zero and for the last 100 samples the cosine function decreases to zero. At the end of the gating operation samples of the modified pulse are held in computer storage and these samples are later transferred to a programmable read-only memory (PROM) in warning equipment to form the basis of warning sounds. Samples for other warning sounds derived in the same way are also stored in the PROM.

Since the amplitude of each sample is stored, the sounds can be regarded as being in pulse code modulation (PCM) form but if required the samples may be recorded to store each sound in Delta modulated form, for example.

In order to provide warning sounds which can be distinguished on the basis of rhythm in addition to pitch and timbre, the pulses in the warning apparatus of the embodiment are assembled into bursts and a number of bursts of different types form a complete warning. A burst having six identical 0.1 second pulses and a basic temporal pattern is shown in FIG. 3*a* while the same burst modified with a loudness contour is shown in FIG. 3*b*. To provide an indication of urgency the pulse spacing is compressed in FIG. 3*c* and compression is taken to the limit in FIG. 3*d*. The types of burst shown in FIGS. 3*a* to 3*d* are designated types 1 to 4 in this specification. Using short pulses and starting with a low-level pulse makes the warnings less annoying, less disruptive and less startling.

One complete warning is shown in FIG. 4 which has a single horizontal time axis joined as indicated by arrows. Each trapezium shown contains a number showing the type of burst employed and the heights of the trapeziums indicate the amplitudes (or maximum amplitudes) of the pulses in the bursts. Also included are rectangles indicating voice warnings and again the heights of the rectangles indicate amplitude.

Having specified sounds which are suitable as auditory warnings, auditory warning apparatus for samples in PCM form is now described.

In FIG. 5 a PROM 32 is regarded as divided into four sections corresponding to four respective warnings and each section comprises a relatively large portion containing the 1024 samples of one pulse of one warning and a relatively small portion containing variables specifying the pulses of different types of burst. These variables are: T—the time between the pulse and the next pulse, R—the rate at which the samples are read out (that is the pitch of the pulse) and A—the amplitude of the pulse. R can be varied from pulse to pulse by a small amount to make warnings more distinctive (for example, with a nominal sampling rate of 10 kHz, variations from 9 to 11 kHz may be employed). A ROM 33, also regarded as being in four sections, contains samples of voice warnings corresponding to the four warnings of the PROM 32, such samples allowing the voice warnings to be generated after digital-to-analogue conversion and amplification. No details of voice warnings are given since they are not part of the present invention.

When a sensor in a group 34 senses that an alarm should be given, a signal is passed to a microprocessor 35. The sensors and known ways of registering their output signals which are already used in aircraft may be employed to provide the required input to the microprocessor. A program is then executed causing a series of the variables T, R and A to be passed by way of a data bus 40 to a mark/space clock 36, a sample rate clock 37 and programmable attenuators 38 and 39. A flow chart for this program is shown in FIG. 6 and described below.

Next and also as part of the program, the pulse samples from the appropriate portion of the PROM 32 are passed to digital-to-analogue converters (DACs) 42 and 43, two converters being provided as a safety measure to give redundancy. The samples are applied to the converters at a sample rate determined by the sample rate clock 37 which is under the control of the variable R. The output signals from the DACs 42 and 43 are passed to the programmable attenuators 38 and 39 which have been set according to the variable A. From these attenuators signals pass by way of a power amplifier 44 to a loudspeaker 45.

A ROM 46 contains the above mentioned program and a RAM 47 provides a working space for the microprocessor 35. The RAM 47 and the ROMs 32, 33 and 46 are addressed by way of an address bus 48. In addition to providing auditory alarms, provision is made for a visual display of alarms using a display means 49 which receives signals direct from the sensors 34.

In order to ensure that the sound levels at loudspeaker 45 are correct, a preflight check is automatically carried out by the system on switch-on and comprises playing each warning in turn and checking the level by means of a microphone 51 and an analogue-to-digital converter 52 which passes levels back to the microprocessor 35 where they are checked against the expected levels.

A flow chart for the above mentioned program is shown in FIG. 6 in a form which can be translated into many suitable languages for assembly into machine code and storage in the ROM 46. Since this translation process is one well known to computer programmers it is not described here. The ROM 46 also contains other programs of known types for initializing and housekeeping purposes, and for the automatic test mentioned, but these programs are not described because they are either conventional or not directly concerned with the invention.

When one of the sensors 34 indicates that a warning should be sounded it is first necessary to identify the warning in an operation 55 and then control words for this warning are fetched into the working space RAM 47 in an operation 56. One set of control words corresponding to each of the trapeziums in the warning and each rectangle, and one control word identifying the waveform samples and the voice warning to be used are stored. Each set of words has sub-groups of three words specifying T, R and A for each pulse in that burst. Thus the set of control words for the trapezium 3 comprises six sub-groups each specifying T, R and A for one of the pulses shown in FIG. 3*c*.

Assuming that there are N pulses in each burst, the variables for the first burst are first fetched from PROM 32 in an operation 57 and held in the RAM 47. These three variables are then loaded by the processor 35 in an operation 58 into the mark space clock 36, the sample rate clock 37 and the programmable attenuators 38 and 39. Next the 1024 amplitude samples for that warning as identified by the operation 55 are passed to the DACs 42 and 43 at a rate set by the sample rate clock 37 and determined by R. Having read out all these samples an operation 60 is carried out in which the clock 36 is counted down from T to zero, thus giving the spacing between the current pulse and the next pulse.

A test 61 is then carried out to determine whether the burst is complete and if not a loop 62 back to the operation 58 follows to allow the next pulse to be generated. When the last pulse has been generated the test 63 follows to determine whether another warning of higher or equal priority has occurred. If not then a test 64 determines whether the last burst in the warning has occurred so that by following a loop 65 the remainder of the bursts in the warning are eventually provided. When a voice warning occurs it is considered as a single burst comprising one long "pulse" with variables T, R and A and the samples read out in the operation 59 are those of the appropriate voice waveform.

Should a warning of higher or equal priority occur as indicated by the test 63 a loop 66 back to the operation 55 occurs allowing this warning to be identified and the appropriate control words to be obtained. Where warnings are of equal priority bursts of different sounds are alternated automatically by means of the test 63 but the program includes operations (not shown) to ensure that the appropriate bursts in the sequence of bursts making up a warning follow one another.

Each warning contains at least one pulse in which all four quasi-harmonically related components are in the range 15 to 30 dB above threshold and at least half the components are more than 20 dB above threshold. Preferably, however, more than half the pulses in each warning contain four quasi-harmonically related components in the range 15 to 30 dB above threshold. Nominally the gain of the amplifier 44 is such that with the programmable attenuators set for an attenuation of zero the required sound output level is obtained from the loudspeaker 45. Thus for the loudest pulse the attenuators 38 and 39 are set to zero. In setting up the system of FIG. 5 in manufacture, the loudest pulse is tested and the A values in the PROM 32 are all changed by the addition or subtraction of the same number until the correct level is obtained. The desired waveform is loaded into the PROM 32 in the usual way but as part of the setting up procedure these levels are modified as mentioned above. Alternatively a potentiometer controlling the gain of the amplifier 44 is set by the manufacturer to give the required level in the loudest pulse.

Although one way of putting the invention into effect has been described it will be clear that many other ways are possible. For example other system block diagrams than that shown in FIG. 5 may be used. Other configurations of auditory warnings than those shown in FIGS. 3*a* to 3*d* are used for different warnings since it is partly the temporal pattern which makes a warning distinctive.

Although it is not recommended, auditory warning apparatus according to the invention may, perhaps to give prominence to certain alarms, generate a few additional sounds having at least one component outside the range 15 to 30 dB above threshold.

Where the auditory indicators are used in other environments such as power stations, ships or trains the same general principles are observed but the invention may be put into effect in rather different ways so long as at least four sounds are provided and each sound contains at least four quasi-harmonically related components in the range 15 to 30 dB above threshold.

I claim:

1. A method for producing an audible warning, comprising the steps of:

(1) storing, in a memory, information representing plural distinctive sounds respectively associated with plural different predetermined conditions, said information representing each sound including:

(a) data representing at least four frequency components each of which is a frequency in the range of plus or minus 10 percent of an integer multiple of a common fundamental frequency within the range of 150 Hz and 1000 Hz, and (b) data representing a maximum power level for each component within a power level range of 15 to 30 decibels above an expected background noise threshold level and below 110 dB standard pressure level;

(2) sensing whenever one of said plural predetermined conditions exists;

(3) fetching the information from said memory representing the one of said sounds associated with a predetermined condition sensed by said sensing step; and (4) generating sound in response to the information fetched by said fetching step, including simultaneously producing four frequency components of sound at frequencies represented by said component-representing data and at power levels represented by said power-level representing data.

2. A method according to claim 1 wherein each sequence of sounds produced by said generating step has a temporal pattern particular to the associated condition.

3. A method as in claim 1 wherein said sound generated in said sound-generating step includes no significant sound components outside of said power level range.

4. A method as in claim 1 wherein:

said information representing each sound stored by said storing step includes information representing plural sequences of plural bursts of plural pulses of sound, at least one of said plural pulses of each of said sequences specified by said frequency-component data and said maximum power level data;

said fetching step includes a step of successively fetching information representing the plural bursts of the sequence associated with a predetermined condition sensed by said sensing step; and said generating step includes a step of generating sound in response to the information fetched by said fetching step.

* * * * *